US007588647B2

(12) United States Patent
Muller et al.

(10) Patent No.: US 7,588,647 B2
(45) Date of Patent: Sep. 15, 2009

(54) AQUEOUS DETERGENT CONCENTRATES FOR ROUGH, ESPECIALLY PROFILED TILES AND FLAGS

(75) Inventors: Felix Muller, Velbert (DE); Jorg Peggau, Essen (DE)

(73) Assignee: Goldschmidt GmbH, Essen (DE)

( * ) Notice: Subject to any disclaimer, the term of this patent is extended or adjusted under 35 U.S.C. 154(b) by 333 days.

(21) Appl. No.: 11/167,691

(22) Filed: Jun. 27, 2005

(65) Prior Publication Data

US 2006/0019864 A1 Jan. 26, 2006

(30) Foreign Application Priority Data

Jul. 24, 2004 (DE) ..... 10 2004 036 067

(51) Int. Cl.
*B08B 3/04* (2006.01)
*C11D 1/68* (2006.01)
*C11D 3/20* (2006.01)

(52) U.S. Cl. ..... 134/42; 134/25.2; 134/38; 134/39; 134/40; 510/238; 510/240; 510/262; 510/356; 510/365; 510/366; 510/506; 510/535

(58) Field of Classification Search ..... 510/238, 510/240, 262, 356, 365, 366, 506, 535; 134/25.2, 134/38, 39, 40, 42
See application file for complete search history.

(56) References Cited

U.S. PATENT DOCUMENTS

| | | | | |
|---|---|---|---|---|
| 3,962,418 | A * | 6/1976 | Birkofer | 510/124 |
| 4,128,484 | A * | 12/1978 | Barford et al. | 510/525 |
| 5,929,024 | A | 7/1999 | Stringer et al. | |
| 2005/0107275 | A1 * | 5/2005 | Hecht et al. | 510/237 |

FOREIGN PATENT DOCUMENTS

| | | | |
|---|---|---|---|
| EP | WO 98/38272 | * | 9/1998 |
| EP | 0928829 B1 | | 7/1999 |
| GB | 2334723 A | | 9/1999 |

OTHER PUBLICATIONS

Akoh, Casimir C. et al., *Preparation of Trehalose and Sorbitol Fatty Acid Polyesters by Interesterification*, JAOCS vol. 66, No. 11 (1989) p. 1581-1587.

Ropuszynski S. et al., *Dehydration of D-Sorbitol in the Presence of Sodium Phosphates*, Tenside Surf. Det. vol. 27, No. 5 (1990) p. 350-351.

* cited by examiner

*Primary Examiner*—Brian P Mruk
(74) *Attorney, Agent, or Firm*—Scully, Scott, Murphy & Presser, P.C.

(57) ABSTRACT

The invention relates to aqueous detergent concentrates based on nonionic, anionic, amphoteric surfactants, with or without the use of customary auxiliaries and additives, said concentrates comprising as cleaning enhancers at least one sorbitan ester of the general formula (I)

(I)

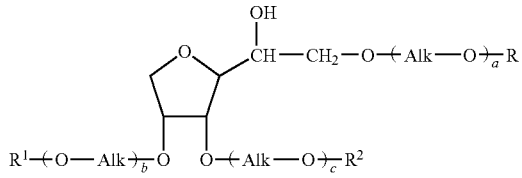

where

R can be an optionally branched, optionally substituted and/or heteroatom-containing saturated or unsaturated acyl radical having 6 to 22 carbon atoms, $R^1$ and $R^2$ independently of one another can be hydrogen or R, Alk is at least one radical from the group consisting of ethylene-, isopropylene-, and butylene-, and a, b and c independently of one another can be values between 0 to 25, where the sum of a+b+c=0 to 25.

15 Claims, No Drawings

AQUEOUS DETERGENT CONCENTRATES FOR ROUGH, ESPECIALLY PROFILED TILES AND FLAGS

FIELD OF THE INVENTION

The present invention relates to aqueous detergent concentrates for rough, especially profiled, stoneware tiles and flags, based on nonionic, anionic or amphoteric surfactants and comprising at least one sorbitan ester, as a cleaning enhancer.

BACKGROUND OF THE INVENTION

For reasons of esthetics and hygiene, the work areas, hallways and stair within both commercial and public buildings, as well as shopping malls are increasingly being laid with natural and stoneware tiles and flags.

In order to avoid accidents due to tripping and slipping, these floor coverings are required to meet certain requirements, with respect to their sureness underfoot. Thus, these flooring coverings are required by the statutory provisions (the guidelines of the German Workplaces Ordinance) to be level, slip resistant, and easy to clean.

The term 'stoneware' is representative of hard-fired tiles and flags which maybe glazed or unglazed, with or without, a fired ceramic surface coating. In accordance with the DIN Standard, there is a subdivision according to water absorption and production method. DIN EN 176 defines stoneware tiles and fine-stoneware tiles (porcelain tiles).

For the slipproof properties, however, it is the surface roughness which is critical. Consequently, the data sheets of the German trade association (ZH 1/571) and of the German municipal accident prevention authorities (GUV 26.17; 26.18) specify precisely defined nonslip classes (R classes) for the various areas of application, with higher R values standing for greater slip inhibition.

The R values are determined in accordance with DIN 51 130 in tests on a sloping plane, and are reported in incline angle ranges: R 9=3°-10° incline angle; R 10=10°-19° incline angle; R 11=19°-27° incline angle; R 12=27°-35° incline angle; R 13=>35° incline angle.

For profiled flags and tiles, additionally, the displacement volume (V) is reported in accordance with DIN 51 130. The displacement volume is the volume between the upper walking plane and the lower water removal plane. The displacement volume lies between V 4 (=4 $cm^3/dm^2$) and V 10 (=10 $cm^3/dm^2$).

For areas with increased risk of slippage, i.e., areas in which floors and steps come into contact with friction-reducing and/or slip-promoting media such as, for example, water, wastes, starchy residues, animal and vegetable fats or oils, mineral fats or oils, soaps, pigment dirt, abraded rubber, and silicones, the appropriate evaluation groups are R>10, especially, R 12 and R 13.

Tiles and flags are generally considered as easy to care for and pleasant to clean. This is undoubtedly true of level, smooth and hard substrates of R classes 9 to 11. As the R class goes up, however, the roughness of the surfaces increases. Those considered problematic are slightly rough substrates of class R 12 and, in particular, profiled tiles and flags of classes R 12 to R 13 and V 8 to 10, known as fine-stoneware tiles/flags.

Cleaning effort is increased considerably as the roughness/unevenness of the substrate increases, especially if porosity results in additional increase in the size of the surface.

There has therefore been no lack of attempts in the past to develop new cleaning methods, in addition, to the special mechanical cleaners, and, in addition, to minimize cleaning effort and optimize the cleaning effect by means of universally applicable all-purpose cleaners, especially detergents tailored precisely to the particular type of flooring and type of soiling.

Commercially customary detergents for manual and machine cleaning are, generally speaking, complex mixtures of anionic, nonionic and amphoteric/zwitterionic surfactants which comprise customary auxiliaries and additives such as alkalis, complexing agents, solubilizers, chlorine bleaching lye additives, and, if desired, mild abrasives. The commercially customary detergents are employed in concentrations from about 0.5 to 10% by weight In practice, however, it has been found that it was often impossible to remove the soiling fully in the first pass, even with great mechanical assistance through the use of microfiber pads, scrubbers, or high pressure apparatus, abrasive suction rollers or brush rollers, and additional intensive rinsing with water, on the problematic fine-stoneware substrates. Additional cleaning steps were necessary.

Apart from the considerable additional expense on operatives and machinery, and the additional environmental burden of detergents, the abrasive action of the mechanical exposure reduces more quickly the sureness of the floor covering underfoot EP-B-0 928 829 describes detergents comprising mixtures of at least the following four components:

a) at least one quaternary ammonium compound having a $C_{1-6}$ hydrocarbon radical and three alkoxy groups,
b) at least one water-soluble alkaline substance from the group consisting of alkali metal hydroxides and alkanolamines,
c) at least one alkylpolyglycoside, and
d) at least one solubilizer from the group consisting of water-soluble alcohols and glycol ethers, which were designed specifically for the cleaning of hard surfaces, especially vertical surfaces, and which when mixed with water are said to give a thickening solution having rheopexic properties. Through selection of components a), b), c) and d) and their concentrations it is possible to control the rheopexy and the foam behavior. There is no reference to the specific problem of the cleaning of fine-stoneware tiles and the effect of improved spreading through alkoxylated ammonium compounds.

GB-A-2 334 723 describes detergents for glass, smooth, bright and glossy surfaces, consisting of one or more ethoxylated quaternary ammonium compounds, at least one glycol ether and/or $C_{1-22}$ alcohol and at least one anionic surfactant. The detergent is said to leave no spots or streaks after cleaning, and to have antimicrobial and antistatic properties. There is no reference here either to the specific problem of the cleaning of rough, non-glossy profiled surfaces, or to the effect of improved spreading through alkoxylated ammonium compounds.

DE-A-100 38 198 provides for the use of aqueous detergent concentrates based on nonionic, anionic, amphoteric surfactants, with or without, the use of customary auxiliaries and additives, said concentrates comprising alkoxylated amine compounds of the general formula $$[R^1, R^2, R^3, R^4N]+X—$$

where $R^1$ is a straight-chain, optionally branched, alkyl radical, optionally containing multiple bonds, having from 8 to 22 carbon atoms, $R^2$ is $—(CH_2CHR^5O)_n—R^6$ where $R^5$=H, $—CH_3$ or $—C_2H_5$; $R^6$=H, $—CH_3$, $—C_2H_5$, $—C_3H_7$ or $—C_4H_9$, and n=1 to 25, $R^3$ is $R^1$ or $R^2$, $R^4$ is $—CH_3$ or $—C_2H_5$, and X— is an anionic radical, especially methyl sulfate, ethyl sulfate, phosphate, chloride, bromide or iodide as cleaning enhancers for cleaning fine-stoneware tiles.

The ethoxylated quats, which are no longer acceptable from an environmental standpoint, do indeed display good cleaning enhancement properties; however, they no longer conform to the requirements for surfactants in detergents. Moreover, the ethoxylated quats do not achieve the required values for biodegradation according to OECD 301 A-F. The cationic surfactants used additionally in DE-A-100 38 198 or U.S. Pat. No. 5,929,024 are ethoxylated alkylamido-alkyldialkylammonium salts, of which it is known that they are firstly problematic and cannot be prepared without objectionable by-products and that they exhibit an increased aquatic toxicity and also a poorer total degradation than the nonionic and/or anionic surfactants customarily used.

Ethoxylated quats can be irritating on skin contact, and some of these compounds may even be toxic to aquatic organisms. Compatibility with materials is also not a given on a variety of surfaces. Here, particular mention may be made of metallic surfaces, on which cationic surfactants, even on stainless steel, lead to corrosion phenomena, and particularly to pitting. Critical to this effect are the counterions, mostly chloride ions.

In modern detergents, therefore, ethoxylated quats are no longer tolerated, on account of their increased environmental risk.

SUMMARY OF THE INVENTION

It is an object of the present invention, therefore, to overcome these disadvantages of the known, commercially customary detergents and to provide improved detergents which, used at the same or reduced concentrations, ensure reliable cleaning of rough and profiled tiles and flags, known as fine stoneware.

This object is achieved by means of detergents based on surfactants and comprising at least one sorbitan ester, as a cleaning enhancer.

The present invention accordingly provides aqueous detergent concentrates, preferably for rough, especially profiled tiles and flags, based on nonionic, anionic, amphoteric surfactants, with or without, the additional use of customary auxiliaries and additives, said concentrates comprising as cleaning enhancers at least one sorbitan ester of the general formula (I)

(I)

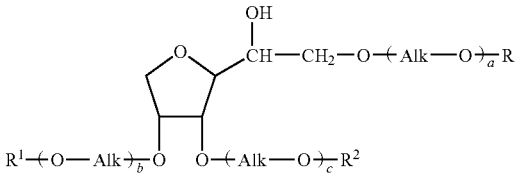

where

R is an optionally branched, optionally substituted and/or heteroatom-containing saturated or unsaturated acyl radical having 6 to 22 carbon atoms, $R^1$ and $R^2$ independently of one another are hydrogen or R, Alk is at least one radical from the group consisting of ethylene-, isopropylene- and butylene-, and a, b and c independently of one another are values between 0 to 25, where the sum of a+b+c=0 to 25.

The present invention further provides aqueous detergent concentrates comprising, based on the overall mixture, apart from water, substantially from 0.1 to 10, in particular from 1 to 10, parts by weight of at least one anionic surfactant, if desired from 0.0 to 20, in particular from 0.1 to 5, parts by weight of at least one nonionic surfactant, if desired from 0.0 to 10, in particular from 0.1 to 8, parts by weight of at least one amphoteric/zwitterionic surfactant, and if desired from 0.1 to 10 parts by weight of customary auxiliaries and additives, wherein said concentrates comprise from 0.1 to 10, in particular from 0.5 to 3, parts by weight of at least one sorbitan ester of the general formula (I).

The present invention further provides for the use of the aqueous detergent concentrates to clean fine-stoneware tiles.

DETAILED DESCRIPTION OF THE INVENTION

The aqueous detergent concentrates of the present invention contain, based on the overall mixture, water in the range from about 45 to about 95 parts by weight, preferably from about 70 to about 90 parts by weight. For use, the aqueous detergent concentrates of the present invention may be diluted with further water to the particular desired and/or customary or necessary use concentration of from about 0.3 part by weight to about 10 parts by weight.

Suitable sorbitan esters the can be employed in the present invention are the monoesters, diesters and triesters of sorbitans with fatty acids and also sorbitan sesquiesters or the polysorbates. Sorbitan sesquiesters denote the mixture of the monoester and diester of the fatty acids with sorbitan. The ethoxylated sorbitan esters are referred to as polysorbates.

(J. Am. Oil Chem. Soc. 66, 1581 (1989); Tenside Surf. Deterg. 27, 350 (1990).)

The cleaning enhancers that are preferably used additionally in accordance with the invention are sorbitan esters of the general formula

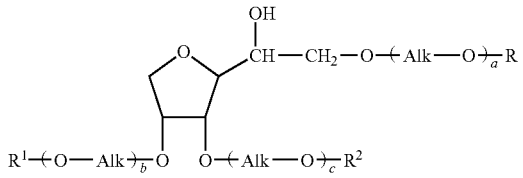

in which

R is an optionally branched and/or heteroatom-containing saturated or unsaturated acyl radical having 6 to 18 carbon atoms, in particular having 6 to 10 carbon atoms, $R^1$ or $R^2$=R, and the sum of a+b+c is<5, in particular 0.

Fatty acids which can also be used in accordance with the present invention are those where R is based on saturated or unsaturated, natural or synthetic, monobasic aliphatic fatty acids having 6 to 22 carbon atoms, preferably 6 to 18, in particular having 6 to 10 carbon atoms, which may optionally be branched, may optionally be substituted, and/or may contain heteroatoms.

Particularly suitable fatty acids in this context are fatty acids which have a chain distribution of from about 6 to about 18, in particular from about 6 to 10, carbon atoms and maybe branched, substituted, preferably —OH substituted, saturated or unsaturated, such as the known and customary monobasic fatty acids based on natural vegetable or animal oils having 6 to 22 carbon atoms such as, for example, undecanoic acid, lauric acid, myristic acid, palmitic acid, palmitoleic acid, isostearic acid, stearic acid, oleic acid, linoleic acid, petroselinic acid, elaidic acid, arachidic acid, behenic acid, erucic acid, gadoleic acid, rapeseed oil fatty acid, soybean oil fatty acid, sunflower oil fatty acid, tall oil fatty acid, which can be used alone or in a mixture in the form of their glycerides, methyl or ethyl esters or as free acids, and also the technical mixtures obtained in the course of pressurized cleavage. Suitable, in principle, are all fatty acids with a similar chain distribution. Particular preference is given in accordance with the present invention to caproic acid, hydroxycaproic acid or caprolactone, sorbic acid, enanthic acid, caprylic acid, 2-ethylhexanoic acid, pelargonic acid and capric acid.

Suitable alkoxylating agents that can be used in the present invention include ethylene oxide, propylene oxide or butylene oxide, alone or as copolymers with both random and block distribution. The degree of alkoxylation is codetermined by the target hydrophilicity of the compound. The degree of alkoxylation is on average between 1 to 25, in particular from 4 to 20.

These compounds are prepared by the known processes, by chemical condensation processes, in the desired molar ratio, or by means of enzyme-catalyzed esterification or transesterification. Whereas with the enzyme-catalyzed processes largely pure monoesters or diesters are preparable, the chemically catalyzed reaction products are in the form of technical mixtures, which as well as the desired monoesters, diesters or triesters always also include fractions of the other esters. These technical esters can be purified by the known processes, i.e., concentrated to the respective mono/di/tri fractions, but can also be used as they are.

These compounds are added to cleaning formulations consisting of mixtures of one or more surfactants selected from the group consisting of anionic, nonionic and amphoteric compounds and, if desired, customary auxiliaries and additives such as alkalis, complexing agents, solubilizers, chlorine bleaching lye additives, and mild abrasives, in amounts from about 0.1 to 5, in particular from 0.5 to 3 parts by weight.

Surprisingly, these nonionic cleaning enhancers do not exhibit the values of a single technical effect at the expense of the other properties, but instead lift the general level overall:

- The sorbitan esters also used in accordance with the invention exhibit good environmental compatibility.
- The sorbitan esters exhibit better spreading on porous surfaces, e.g., porcelain tiles (optimized wetting, particularly on porous surfaces—where the real surface area is a multiple of the actual footprint area—leads to better soil detachment. The shadow regions of the antislip elevations are also wetted and cleaned adequately.).
- The sorbitan esters exhibit better lime soap dispersing capacity (optimized dispersing capacity: for insoluble inorganic soiling, prevents the settling of such soiling. This is particularly important on porous surfaces, since these residues are otherwise impossible to remove.).
- The sorbitan esters exhibit better emulsifying capacity for simple, inexpensive surfactant systems: (optimized emulsifiability, since the entire oil is present continuously in the emulsion. Where there is settling of water, resoiling owing to a breaking emulsion does not occur.). In order not to reduce the slip resistance properties, it is especially important here to remove all residues completely, so that the required pores do not become clogged.

The surface-active compounds that can also be used in accordance with the invention are the anionic, nonionic, amphoteric/zwitterionic surfactants customary in this field for preparing domestic and industrial detergents.

The compounds may be used individually or as mixtures and are, for example, anionic, nonionic and amphoteric surfactants such as alkali metal, ammonium or magnesium alkyl sulfates and alkyl ether sulfates, secondary alkane sulfonates, alkali metal α-olefin sulfonates, sulfosuccinates, acyl isethionates, sarcosides, taurides, ether citrates, carboxylates, ether carboxylates, alkylamide ether sulfates, and also amine oxides, alkyl betaines, alkylamido betaines, propionates, glycinates, acetates and sulfobetaines, and sodium soaps, potassium soaps or triethanolamine soaps.

In the detergent formulation of the present invention, use is made in particular of secondary alkanesulfonates and/or alkyl sulfates or linear alkylbenzenesulfonates, particular preference being given to $C_{8-14}$ alkyl sulfates and $C_8$ alkanesulfonates.

Preferred nonionic surfactants are the fatty alcohol polyglycol ethers. By fatty alcohol polyglycol ethers are meant, in accordance with this invention, unbranched or branched, saturated or unsaturated $C_{6-22}$ alcohols alkoxylated with ethylene oxide (EO) and/or propylene oxide (PO), having a degree of alkoxylation of up to 30, preferably ethoxylated $C_{8-14}$ fatty alcohols having a degree of ethoxylation of less than 30, preferably having a degree of ethoxylation of from 1 to 20, in particular from 1 to 12, more preferably from 1 to 8, and very preferably from 2 to 5, examples being $C_{9-13}$ fatty alcohol ethoxylates with 2, 3 or 4 EO or a mixture of the $C_{8-12}$ fatty alcohol ethoxylates with 3 and 4 EO in a weight ratio of 1 to 1.

Likewise used in such systems are, customarily, amphoteric surfactants. In accordance with the present invention, preference is given to amphoglycinates, especially the caprylaminodipropionate and the caprylamphopropionate, because both surfactants exhibit good cleaning performance and good stability at high pH values and introduce a low foam load into the system.

The builder system is composed of alkali metal hydroxide, preference being given in this case to potassium hydroxide, and of a complexing agent, which can be selected from the following group:

NTA, nitrilotriacetic acid and its sodium salts, EDTA, DTPA, diethylenetriaminepentaacetic acid, PDTA, propylenediaminetetraacetic acid, ADA, alaninediacetic acid, Na salt, MGDA, methylglycinediacetic acid, IDS Na salt, iminodisuccinic acid sodium salts, Octaquest E, ethylenediamine-N, N'-disuccinic acid, trisodium salt, citrates (salts of citric acid), gluconates (salts of gluconic acid), phosphates (diphosphates, metaphosphates and polyphosphates), phosphonates such as ATMP, aminotrimethylenephosphonic acid, EDTMP, ethylenediaminetetra(methylenephosphonic acid), DTPMP, diethylenetriaminepenta-(methylenephosphonic acid), HEDP, 1-hydroxyethan-1,1-diphosphonic acid, PBTC, 2-phosphonobutane-1,2,4-tricarboxylic acid, and HDTMP, hexamethylenediaminetetra(methylenephosphonic acid).

The customary or possible compounds of the individual groups that can be used in this field are part of the skilled worker's general knowledge and may additionally be looked up if required in the relevant technical literature and also in the manufacturers' formula recommendations for the respective classes of surfactant.

IMPLEMENTATION EXAMPLES

| A. Test products: | |
|---|---|
| Fine stoneware used: | Sorbitan monooctanoate |
| Manufacturer: | Villeroy & Boch AG |
| Name of tiles: | ATHOS |
| Material: | unglazed vitreous |
| Color: | natural light |
| Dimensions: | 30.0 × 30.0 cm |
| Article number: | 2038 |
| Color code: | VA5M |
| Slip resistance: | R 9 |

Detergents:

Composition of Commercially Customary Detergents

| | Surfactants | | | Builders | | | |
|---|---|---|---|---|---|---|---|
| | Nonionic % | Anionic % | Amphoterics | Alkalis | Complexing agents | Alcohols | pH |
| A | 5-15 | <5 | | + | + | | 13 |
| B | 5-15 | <5 | | + | | + | 11 |
| C | 5-15 | | | + | | | 11 |

+ = present

Base Detergents:

| Amounts in % of active substance | V1 U.S. Pat. No. 5 929 024 Ex. 7A | V2 WO 99/09121 Ex. 1D | V3 DE 100 38 198 | E1 | E2 |
|---|---|---|---|---|---|
| $C_{14-17}$ sec. alkanesulfonate (HOSTAPUR ® SAS 60, Clariant) | 2.0 | 3.12 | | | |
| $C_8$ alkane sulfate (REWOPOL ® D 510) | | | 2.00 | 2.00 | 2.00 |
| Alkyldimethyl-polyoxy-ethylene-ammonium chloride (REWOQUAT ® CPEM/VARIQUAT 638) | 2.00 | | 3.00 | | |
| $C_8$ capryliminodipropionate (TEGOTENS ® 475) | 2.00 | | 3.00 | | |
| Capryloamphopropionate (REWOTERIC ® AM VSF) | | | | 3.0 | 3.0 |
| $C_{9-14}$ fatty alcohol EO/PO (Plurafac/Marlox) | | 0.94 | 2.00 | | |
| $C_{9-11}$ fatty alcohol EO (Imbentin/Lutersol) | | | | 3.00 | 2.20 |
| $C_{6-10}$ sorbitan esters (inventive) | | | | 2.00 | 2.00 |
| PEG-6 coconut fatty acid triglyceride (Levenol F-200, Kao) | | 0.94 | | | |
| Diethylene glycol monomethyl ether (DPM) | 3.50 | 4.75 | | | |
| Coconut fatty acid | | 0.45 | | | |
| $MgSO_4 \cdot 7\ H_2O$ | | 1.2 | | | |
| KOH, 45% | | | 1.8 | 5.0 | 5.0 |
| Gluconic acid, 50% | | | | 6.0 | |
| Methylglycinediacetic acid ($Na_3MGDA$; Trilon ® M) | | | | | 6.0 |
| Diethylenepenta-methylenephosphonic acid (DEQUEST ® 2066, Monsanto/SEQUION ® 40 Na 32, Polygon) | | | 2.0 | | |
| Water, auxiliaries | up to 100 | up to 100 | up to 100 | up to 100 | up to 100 |

FURTHER INVENTIVE EXAMPLES

| Amounts in % of active substance | E3 | E4 | E5 | E6 | E7 |
|---|---|---|---|---|---|
| $C_8$ alkane sulfate (REWOPOL ® D 510) | 2.00 | 2.00 | 2.00 | 2.00 | 2.00 |
| Capryloamphopropionates (REWOTERIC ® AM VSF) | 3.0 | 3.0 | 3.0 | 3.0 | 3.0 |
| $C_{9-11}$ fatty alcohol EO (Imbentin/Lutensol) | 3.0 | 3.0 | 3.0 | 3.0 | 3.0 |
| Mono-$C_8$ sorbitan ester (enzymatic synthesis) | 2.0 | | | | |
| Di-$C_8$ sorbitan ester (enzymatic synthesis) | | 2.0 | | | |
| Mono/di-$C_8$ sorbitan ester (enzymatic synthesis) | | | 2.0 | | |
| PEG-20 $C_{10}$ sorbitan ester | | | | | 2.0 |
| $C_{12}$ soibitan ester (TEGO ® SML) | | | | 2.0 | |
| KOH, 45% | 5 | 5 | 5 | 5 | 5 |
| Gluconic acid, 50% | 6 | 6 | 6 | 6 | 6 |
| Water, auxiliaries | up to 100 | up to 100 | up to 100 | up to 100 | up to 100 |

Typical Service Dilutions of the Floor Cleaners:

| | | |
|---|---|---|
| All | 1.2% | Normal general-purpose household floor cleaner |

Performance Testing:

1. Spreading Test, Dynamic Measurement:

Measurement Procedure for Dynamic Contact Angle:

The detergents prepared as in the table above were used in a 1.2% dilution and, using the Krüss DSA 10 HS contact angle measuring instrument, the contact angle on ATHOS-brand tiles from Villeroy & Boch was measured. For this purpose, the detergents of the present invention in 1.2% dilution were standardized to a temperature of 20.0° C. and measured in a chamber acclimatized to 20° C.

Tile Surface Preparation:

The dirty tiles were first cleaned roughly with water and then cleaned with analytical-grade ethyl acetate to remove any remaining residues of the service dilution.

The tiles were stored in a box in a chamber acclimatized to 20° C., in order to protect them against environmental effects and dust and to ensure the measurement temperature of 20° C.

Procedure:

4.0 μl of the dilution was applied dropwise to the tile and the contact angle of the solution spreading on the tile was recorded with 120 images for 6 seconds, all using the measuring instrument. In order to obtain a highly precise average value of the desired contact angle, about twelve measurements were carried out in each case on three different tiles of the same kind, and subsequently the measured values thus obtained were transferred to the tabular calculation program and the contact angle was plotted graphically as a function of time.

As described above, three measurements of each of the 0.6% service dilutions of the microemulsions were carried out on three different tiles, transferred to a diagram, and obtained therefrom as an average value. The exact contact angle at 5 seconds was obtained by interpolating the measurement values, since with 120 images in 6 seconds the measuring instrument did not always take a picture at 5 seconds precisely.

The contact angles obtained from plotting and evaluation are to be found as results below.

Results of the Contact Angle Measurement:

| Detergent formulation Service solution: | Dynamic contact angle after | | |
|---|---|---|---|
| 1.2% Description | 1 sec. | 3 sec. | 5 sec. |
| V 01 | 26.3 | 23.3 | 21.6 |
| V 02 | 25.0 | 21.1 | 19.3 |
| V 03 | 37.9 | 32.0 | 29.1 |
| E 01 | 19.9 | 17.0 | 15.1 |
| E 02 | 22.8 | 19.9 | 17.8 |
| E 03 | 26.2 | 19.9 | 17.3 |
| E 04 | 27.0 | 21.3 | 19.0 |
| E 05 | 26.9 | 20.6 | 18.0 |
| E 06 | 31.1 | 26.6 | 24.5 |
| E 07 | 20.3 | 17.5 | 15.5 |

Here it is apparent that, in particular, the sorbitan esters prepared from fatty acids<$C_{10}$ display particular performance in respect of good dynamic spreading capacity. The difference in preparation method, chemical or enzymatic, plays a minor role here, although the monoesters are to be preferred.

2. Emulsifying Behavior

Here, only the behavior of test solution E was investigated, since with the other cleaners the high proportion of nonionic surfactants did not suggest any distinct increase in the emulsifying behavior. Test solution E contains only short-chain anionic surfactants, and surfactant systems of this kind are known to have a weakness in terms of emulsifying behavior.

Test Method:

100 g of use solution of a cleaner were mixed with 90 g (=100 ml) of olive oil. The mixture was then emulsified in an Ultra-Turrax T25 at 8000 rpm for 30 seconds. This emulsion was placed in a 250 ml graduated cylinder. After 15, 30, 60, 120, and 180 minutes, and after 24 hours, the volume proportion of the individual phases was read off.

| | | 100 ml olive oil + 100 g 1.2% strength solution V 01 | 100 ml olive oil + 100 g 1.2% strength solution V 02 | 100 ml olive oil + 100 g 1.2% strength solution V 03 | 100 ml olive oil + 100 g 1.2% strength solution E 01 | 100 ml olive oil + 100 g 1.2% strength solution E 02 |
|---|---|---|---|---|---|---|
| 00:15 | Foam | | | | | |
| | Oil | | 50 | 2 | | |
| | o/w emulsion | 200 | 150 | 198 | 200 | 200 |
| | Water | | | | | |
| 00:30 | Foam | | | | | |
| | Oil | | 52 | 6 | | |
| | o/w emulsion | 200 | 148 | 194 | 200 | 200 |
| | Water | | | | | |
| 01:00 | Foam | | | | | |
| | Oil | drops | 54 | 6 | | |
| | o/w emulsion | 200 | 146 | 194 | 200 | 200 |
| | Water | | | | | |
| 02:00 | Foam | | | | | |
| | Oil | <1 | 60 | 10 | | |
| | o/w emulsion | 200 | 140 | 190 | 200 | 200 |
| | Water | | | | | |
| 03:00 | Foam | | | | | |
| | Oil | 2 | 70 | 12 | | |
| | o/w emulsion | 198 | 130 | 188 | 200 | 200 |
| | Water | | | | | |
| 1 day | Foam | | | | | |
| | Oil | 2 | 110 | 150 | | |
| | O/w emulsion | | 90 | 50 | 200 | 200 |
| | Water | | | | | |

Results:

As is evident, the emulsifying behavior of weakly emulsifying, short-chain anionic surfactant solutions was greatly optimized through the addition of the cleaning enhancers of the invention. If the emulsion breaks, water then settled instead of the oil. This settling water does not impair the cleaning power or soil transport capacity during a cleaning operation. In comparable solutions, the sorbitan esters in particular displayed a significant gain in emulsifying performance here: in other words, translated to cleaning applications, an increased soil transport capacity.

Cleaning Experiments According to Practical Methods:

In addition to the dynamic spreading measurement, a selection of the formulations specified here were subjected to a standardized cleaning test by an independent institute, the Institute Fresenius. Those tested were tile cleaner E 01, tile cleaner V 03 (according to DE-A-100 38 198), tile cleaner V 01 and tile cleaner V 02.

Test Staining: Floor Staining

The tests were carried out using a mixture of the following household floor stains:

aged sunflower oil humus soot iron oxide cement silica loam

First of all the sunflower oil was aged with heating and then taken up in an organic solvent in a 1:1 ratio. This mixture was stirred for 24 hours and thereafter the remaining components of the stain were added. This soil suspension was then sprayed onto precleaned fine-stoneware tiles and subjected to defined drying.

Test Conditions:

| | |
|---|---|
| Test instrument | Sheen Wet Abrasion Scrub Tester REF 903 PG |
| Wiping material | Cleaning cloth BD Art. No. 02010100; color blue WECOVI Trading GmbH, Am Hasenberg 52, 46446 Emmerich wound around plastic block |
| Soil substrate | 30 × 30 cm fine-stoneware tiles Athos, Art. No. 2038 |
| Amount of soil | 0.5 g soil suspension/flag |
| Soil area | 180 $cm^2$ |
| Applied weight | 200 g |
| Wiping rate | 20 strokes/min |
| Number of strokes | n strokes |
| Amount of detergent | 7 ml of diluted product per cloth |
| Number of measurements | 10 flags per product |

Preparations of the Test Products:

The following dilutions were prepared of the test products, using municipal water (12° dH [German hardness]).

Procedure:

After drying, the stained test surfaces were cleaned with a wipe test instrument. The wipe test instrument offers the possibility of testing up to four detergents in parallel on one test surface. It was further ensured in this context that the positioning of the detergents under investigation on the surface to be cleaned was randomized.

Actual cleaning took place with washed cloths clustered according to weight, which were clamped into the cloth holders of the wipe test instrument.

Immediately prior to the cleaning operation, the cloths were clamped into the holders and charged with the dilute detergent solution. In the course of the cleaning operation, the cloths with the products under investigation wiped over the stained test area alongside one another.

Result:

TABLE 1

| Average rating (% soil solutions) after n wiping strokes of the individual test products of detergent group PF | | | | |
|---|---|---|---|---|
| Number of strokes n | Detergent E 01 | Detergent V 03 | Detergent V 02 | Detergent V 01 |
| 10 | 11 | 10 | 10 | 10 |
| 20 | 24 | 20 | 21 | 19 |
| 30 | 36 | 29 | 30 | 28 |

With these results it is possible to show that the formulations according to the invention lead to better results in practice, as well, than the system containing ethoxylated quat (V 03), and do so with a substantially more favorable environmental behavior.

While the present invention has been particularly shown and described with respect to preferred embodiments thereof, it will be understood by those skilled in the art that the foregoing and other changes in forms and details maybe made without departing from the spirit and scope of the present invention. It is therefore intended that the present invention not be limited to the exact forms and details described and illustrated, but fall within the scope of the appended claims.

What is claimed is:

1. An aqueous detergent concentrate comprising, apart from water, as a cleaning enhancer, from 0.1 to 10 parts by weight of sorbitan ester(s) of the general formula (I)

(I)

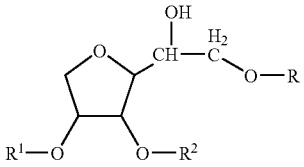

wherein

R is a saturated or unsaturated acyl radical having 8 carbon atoms, and $R^1$ and $R^2$ independently of one another are hydrogen or R.

2. The aqueous detergent concentrate as claimed in claim 1, where said saturated or unsaturated acyl radical is branched, substituted, contains a heteroatom or contains a mixture thereof.

3. The aqueous detergent concentrate as claimed in claim 1, wherein R is an optionally branched, optionally substituted saturated or unsaturated hydrocarbon radical.

4. The aqueous detergent concentrate as claimed in claim 1, wherein $R^1$ or $R^2$ is hydrogen.

5. The aqueous detergent concentrate as claimed in claim 1, wherein R is an optionally branched, optionally substituted saturated or unsaturated hydrocarbon radical, and $R^1$ and $R^2$ are hydrogen.

6. The aqueous detergent concentrate as claimed in claim 1, further comprising, from 0.1 to 10 parts by weight of at least one anionic surfactant, from 0.0 to 20 parts by weight of at least one nonionic surfactant, from 0.0 to 10 parts by weight of at least one amphoteric/zwitterionic surfactant, and from 0.1 to 10 parts by weight of customary auxiliaries and additives.

7. The aqueous detergent concentrate as claimed in claim 6, comprising as cleaning enhancers sorbitan esters in which R is an optionally branched, optionally substituted saturated or unsaturated hydrocarbon radical, and $R^1$ and $R^2$ are hydrogen.

8. A process of cleaning rough fine stoneware comprising applying to said fine stoneware an aqueous detergent concentrate, said concentrate comprising, apart from water, as a cleaning enhancer, from 0.1 to 10 parts by weight of sorbitan ester(s) of the general formula (I)

(I)

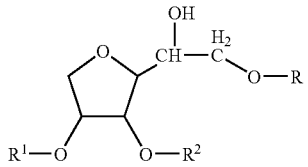

wherein

R is a saturated or unsaturated acyl radical having 8 carbon atoms, and $R^1$ and $R^2$ independently of one another are hydrogen or R.

9. The process as claimed in claim 8, where said saturated or unsaturated acyl radical is branched, substituted, contains a heteroatom or contains a mixture thereof.

10. The process as claimed in claim 8, wherein R is an optionally branched, optionally substituted saturated or unsaturated hydrocarbon radical.

11. The process as claimed in claim 8, wherein $R^1$ or $R^2$ is hydrogen.

12. The process as claimed in claim 8, wherein R is an optionally branched, optionally substituted saturated or unsaturated hydrocarbon radical, and $R^1$ and $R^2$ are hydrogen.

13. The process as claimed in claim 8, further comprising, from 0.1 to 10 parts by weight of at least one anionic surfactant, from 0.0 to 20 parts by weight of at least one nonionic surfactant, from 0.0 to 10 parts by weight of at least one amphoteric/zwitterionic surfactant, and from 0.1 to 10 parts by weight of customary auxiliaries and additives.

14. The process as claimed in claim 13, comprising as cleaning enhancers sorbitan esters in which R is an optionally branched, optionally substituted saturated or unsaturated hydrocarbon radical, and $R^1$ and $R^2$ are hydrogen.

15. A process as claimed in claim 8, wherein said rough fine stoneware comprises profiled tiles and/or flags of fine stoneware.

* * * * *